US005884646A

United States Patent [19]

Ju

[11] Patent Number: 5,884,646

[45] Date of Patent: Mar. 23, 1999

[54] FOLDABLE TENT FRAME FOR COUPLING TENT CLOTH WITH TENT FRAME IN INTEGRAL FORM

[75] Inventor: Dong Soo Ju, Seoul, Rep. of Korea

[73] Assignee: Bae Jin Corporation, Seoul, Rep. of Korea

[21] Appl. No.: 843,449

[22] Filed: Apr. 16, 1997

[30] Foreign Application Priority Data

Feb. 11, 1997 [KR] Rep. of Korea ..... 1997 1946

[51] Int. Cl.[6] ..... E04H 15/00

[52] U.S. Cl. ..... 135/135; 135/147; 135/124

[58] Field of Search ..... 135/135, 138, 135/140, 147, 158, 118, 119, 120.3, 124, 156

[56] References Cited

U.S. PATENT DOCUMENTS

| | | | |
|---|---|---|---|
| 1,714,698 | 5/1929 | Stoll . | |
| 1,820,002 | 8/1931 | Forrester | 135/140 |
| 1,846,496 | 2/1932 | Mills . | |
| 2,440,557 | 4/1948 | Power | 135/156 X |
| 3,168,101 | 2/1965 | Porter | 135/156 |
| 3,181,542 | 5/1965 | Bareis | 135/156 X |
| 3,182,672 | 5/1965 | Biller, Jr. | 135/156 |
| 3,223,098 | 12/1965 | Dole, Jr. | 135/156 X |
| 4,074,682 | 2/1978 | Yoon | 135/135 |
| 4,665,935 | 5/1987 | Nichols | 135/119 X |
| 4,750,509 | 6/1988 | Kim . | |
| 5,139,040 | 8/1992 | Kelly | 135/75 X |
| 5,195,551 | 3/1993 | Ju | 135/135 X |
| 5,261,436 | 11/1993 | Funk | 135/119 X |
| 5,673,720 | 10/1997 | Cuthill | 135/135 X |

FOREIGN PATENT DOCUMENTS

| | | | |
|---|---|---|---|
| 1062582 | 9/1979 | Canada . | |
| 0 507 012 A1 | 10/1992 | European Pat. Off. . | |
| 0 684 355 A2 | 11/1995 | European Pat. Off. . | |
| 2 422 777 | 4/1979 | France . | |
| 7117078 | 6/1972 | Netherlands . | |
| 039753 | 11/1985 | Rep. of Korea . | |
| 2136845 | 9/1984 | United Kingdom | 135/135 |

*Primary Examiner*—Carl D. Friedman
*Assistant Examiner*—Beth A. Aubrey
*Attorney, Agent, or Firm*—Feix & Feix

[57] ABSTRACT

Foldable tent frame for coupling a tent cloth with the tent frame in an integral form is disclosed. Each of the foldable tent frame members for tension-supporting the tent cloth from all sides includes a plurality of rods each having protuberances on both ends thereof with an elliptical flat spring coupled with it, hinged straight joints each having a securing sleeve, and a hinged bent joint, so that the tent can be folded into a compact size so as to make it convenient to carry and store, and that the tent can be set up into a firm large tent in a simple manner by unfolding the frame. Further, the structure of the frame is simple, and the materials constituting the frame are strong. Further, the replacement of the components is easy, and the sleeve has holes for discharging foreign materials such as sands. Thus the tent is ensured of a convenience of use and structural safety.

8 Claims, 9 Drawing Sheets

FOLDABLE TENT FRAME FOR COUPLING TENT CLOTH WITH TENT FRAME IN INTEGRAL FORM

BACKGROUND OF THE INVENTION

1. Field of the Invention

The present invention relates to a foldable tent frame for coupling a tent cloth with the tent frame in an integral form. In particular, the present invention relates to a foldable tent frame for tension-supporting the tent cloth from all sides, which includes a plurality of rods each having protuberances on both ends thereof with an elliptical flat spring coupled with it, hinged straight joints each having a securing sleeve, and a hinged bent joint, so that the tent can be folded into a compact size so as to make it convenient to carry and store, and that the tent can be unfolded into a firm large tent in a simple manner by unfolding the frame.

2. Description of the Prior Art

A typical conventional tent is disclosed in French Patent 2,422,777 and British Patent 2136845A, and this conventional tent has a plurality of frame members which are inserted into connecting devices, so that the tent can be installed to the desired height.

The tent of this type is economically advantageous. However, when the tent is disassembled, the separated frame members are liable to be lost, while when the tent is installed, all the joints of the frame members have to be assembled one by one. Consequently, time and efforts are much expended, and a severe inconvenience is encountered.

In an attempt to overcome the above disadvantages, another tent is disclosed in U.S. Pat. No. 4,074,682, and in this tent, the frame members are connected in the form of hinges.

In this conventional tent, there is no apprehension that the frame members are lost, and the tent can be speedily installed compared with the tent using the connecting devices.

In this tent however, its fixing posture is not secure. That is, if the tent receives a biased pressure by wind, the hinges of the frame members can be folded inwardly, with the result that the frame member may fall down. Thus there is a problem in the postural stability.

There is still another tent which is disclosed in U.S. Pat. No. 1,846,496. In this conventional tent, in order to more securely fix the hinge portion of the frame member, a sleeve is fitted to a hinge portion across two joining segments, and a fixing rod is fitted to it. Further, a lever having a ratchet on the sleeve is installed by means of a spring.

The structure of this tent is very complicated, and therefore, the production cost is raised. Further, the frame can be unfolded in a state with the lever pressed, and therefore, the unfolding manipulation is inconvenient. Further, during the use of the tent, the user may be injured, or the tent cloth or the user's cloth may be damaged.

Particularly, the upper folding portion of a frame member consists of a simple hinge, and therefore, its strength for supporting the ceiling of the tent is weak. Further, a separate securing device should be disposed at the crest portion for maintaining the frame members in the horizontal posture, thereby further making the frame structure complicated.

In an attempt to overcome the above described disadvantages of the foldable tent, there is disclosed still another tent in Korean Utility Model 39753 and U.S. Pat. No. 4,750,509 which were granted to the present applicant. In this conventional tent, a ratchet is installed on a hinge portion between frame member segments by means of a spring. Thus, if the frame members are unfolded, the ratchet is automatically engaged with an engaging piece of the frame member, thereby fixing the frame member in a straight form.

This tent ensures a folding convenience and a postural stability. Once the tent is installed, the frame members are not bent against a wind pressure, and the tent can never be collapsed. Particularly, the upper segment of a frame member forms a certain angle relative to the lower segment of the frame member owing to a bending of a connecting tube of the hinge. Therefore, the roof of the tent is firmly supported, and therefore, a separate device is not disposed on the crest portion of the tent.

However, the spring of the hinge portion is exposed, and therefore, it is aesthetically undesirable. Further, the bottom parts of the frame members support the tent cloth by being inserted into bands which are sewed to the tent cloth like in the previous methods. Therefore, the frame members are easily separated from the tent cloth during the folding of the tent, this being a problem.

In the above described conventional tents, the structure of the hinge portion is complicated, and therefore, the commodity value is degraded. Further, human fingers are liable to be caught into the gap of the spring of the ratchet, and the upper bent portions of the frame members are weak, with the result that the tent supporting strength is weak. Further, the bottom parts of the frame members are inserted into the bands which are sewed to the tent cloth, and therefore, if the tent is oscillated, the frame members are liable to depart from the bands.

Further, in the conventional foldable tents, the segments of the frame members are joined either by providing a joint and a rod in each of them through an injection molding, or are joined by means of pins. Therefore, during a repair or replacement of a frame member, the total frame has to be replaced together, and therefore, losses in time and economy are significant. Further, the conventional foldable tents use elastic frame members so as to form dome shaped tents, and therefore, the frame members are too weak to support a large sized tent such as a family cabin tent or sun shelter or screen shelter.

SUMMARY OF THE INVENTION

The present invention is intended to overcome the above described disadvantages of the conventional techniques.

Therefore it is an object of the present invention to provide a foldable tent frame for coupling a tent cloth with the tent frame in an integral form, in which the structural advantages of Korean Utility Model 39753 (U.S. Pat. No. 4,750,509) are preserved, and its disadvantages are remedied, so that the tent can be installed in a simple manner, and that the assembled tent frame is strong enough to withstand against wild winds.

It is another object of the present invention to provide a foldable tent frame for coupling a tent cloth with the tent frame in an integral form, in which hooks of supporting devices of the tent frame members are coupled with supporting plates attached to the tent cloth, so that the supporting devices of the frame members will not depart from the supporting plates except by intentionally separating them.

It is another object of the present invention to provide a foldable tent frame for coupling a tent cloth with the tent frame in an integral form, in which the springs of the joints are not exposed to the outside so as to prevent human fingers from being caught by the spring, the joints are aesthetically desirable so as to upgrade the commodity value, and a high strength material is used for the frame so as to be strong enough to support a large sized tent.

BRIEF DESCRIPTION OF THE DRAWINGS

The above objects and other advantages of the present invention will become more apparent by describing in detail the preferred embodiment of the present invention with reference to the attached drawings in which.

DETAILED DESCRIPTION OF THE PREFERRED EMBODIMENT

Figure 1:
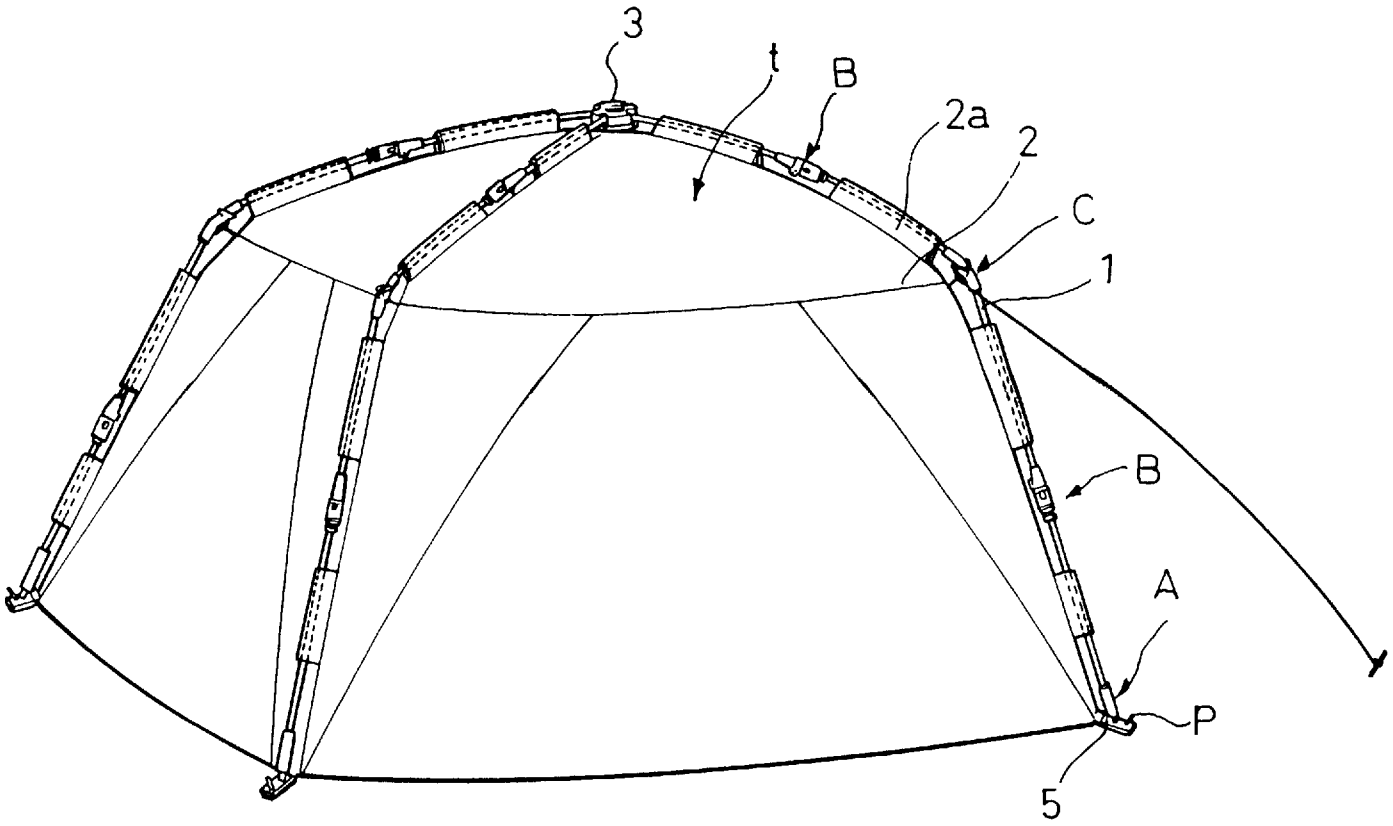
FIG. 1 is a perspective view of the tent according to the present invention.
Figure 2:
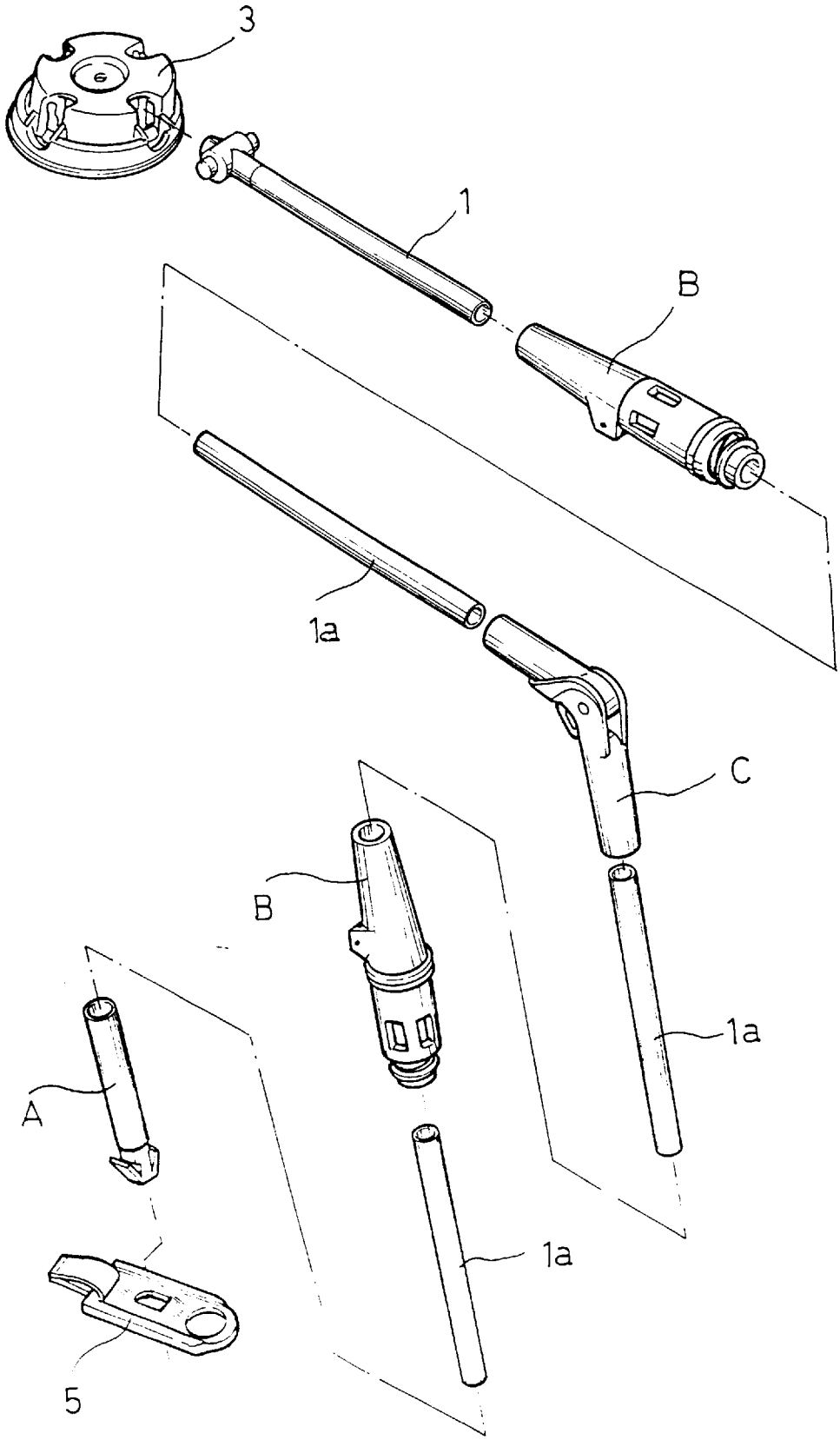
FIG. 2 is an exploded perspective view of the frame member according to the present invention.

As shown in FIGS. 1 and 2, upper portions of a plurality of tent frame members 1 are secured to a hub 3 in a radiative form like an umbrella. A tent cloth 2 can be unfolded in a state with the frame members 1 coupled with supporting cloths 2*a*. Each of the frame members 1 includes: a plurality of rods 1*a*, a grounding device A, hinged straight joints B and a hinged bent joint C.

Each of the frame members 1 is bent at the bent joint C, and the lower portion of the frame member 1 serves as a supporting pole, while the upper portion of the frame member 1 serves as a rafter.

The rods 1*a* are constituents of the frame member 1, and the grounding device A makes the lower portion of the frame member 1 and the lower portion of the tent cloth 2 coupled together, so that the lower portion of the tent would be widely contacted to the ground. The joints B and C are the means which make it possible to fold or unfold the frame member 1.

The rod 1*a* is composed of an elongated pipe, and within the rod 1*a*, there are inserted a symmetrically bent elliptical flat spring is and an arcuate auxiliary spring 1*t*. A protuberance 1*n* is formed at a middle of the spring 1*s*, and the protuberance 1*n* is made to project through a hole 1*h* of the rod 1*a*. These springs are installed near the both ends of the rod 1*a*.

If the rods 1*a* together with the grounding device A are inserted into the holes of the joints B and C, a firm frame member 1 is formed owing to the protuberance 1*n*. The coupling protuberance 1*n* can be elastically pushed into the hole 1*h* owing to the balanced flat spring 1*s*. Therefore, when disassembling or replacing for repair of the frame member or for replacement of the rod, the coupling protuberance 1*n* can move up and down, and therefore, the rod 1*a* can be easily taken out or put into the joint by pressing the protuberance 1*n*.

Figure 3:
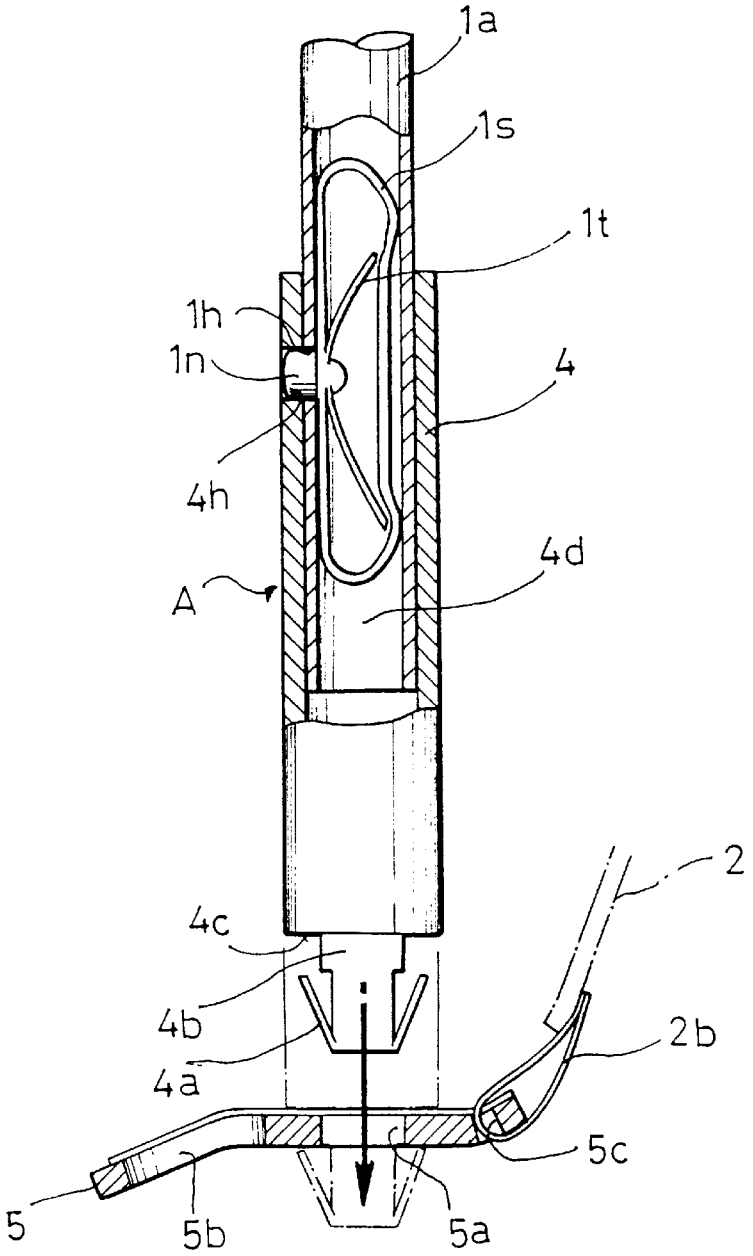
FIG. 3 is a partly sectional view showing the rod fixing device of the portion A of FIG. 2.

Further, as shown in FIG. 3, the grounding device A includes a tubular supporting body 4 having a hole 4*h* and an insertion hole 4*d* for inserting the rod 1*a*. The insertion hole 4*d* of the supporting body 4 receives the rod 1*a*, and the coupling protuberance in is inserted into the hole 4*h*, thereby making it possible to firmly couple the rod 1*a* to the supporting body 4 of the grounding device A. If the protuberance 1*n* is pressed, and the rod 1*a* can be pulled out, and the rod 1*a* can be separated from the supporting body 4. On the bottom of the supporting body 4, there is formed an insertion part 4*b* on which a V shaped hook 4*a* is formed symmetrically.

Figure 4:
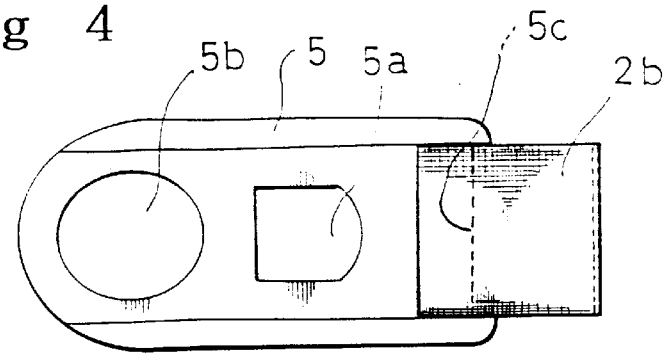
FIG. 4 is a plan view of the supporting plate of FIG. 3.

As shown in FIG. 4, a supporting plate 5 made of a synthetic resin and having an insertion hole 5*a* and a pin(stake) hole 5*b* is attached on the bottom edge of the tent cloth 2. This supporting plate 5 is sewed on the bottom edge of the tent cloth 2 through a band 2*b* and connecting holes 5*c*. If the inserting part 4*b* of the supporting body 4 is inserted into the insertion hole 5*a*, a lower part 4*c* of the supporting body 4 is closely contacted to the supporting plate 5 as shown by one-dot chain lines in FIG. 3. At the same time, the hook 4*a* is spread below the insertion hole 5*a*, so that the lower part 4*c* of the supporting body 4 would be engaged to the supporting plate 5, thereby fixing the supporting body 4.

Supporting cloths 2*a* of the tent and the supporting plate 5 are aligned along the same frame member 1. Therefore, when the tent is unfolded and installed, the lower portion of the tent is spread forming a space owing to the coupling between the supporting body 4 and the supporting plate 5. A pin(stake) P is driven through the pin(stake) hole 5*c* of the supporting plate 5 into the ground, thereby fixing the tent to the ground.

Figure 5:
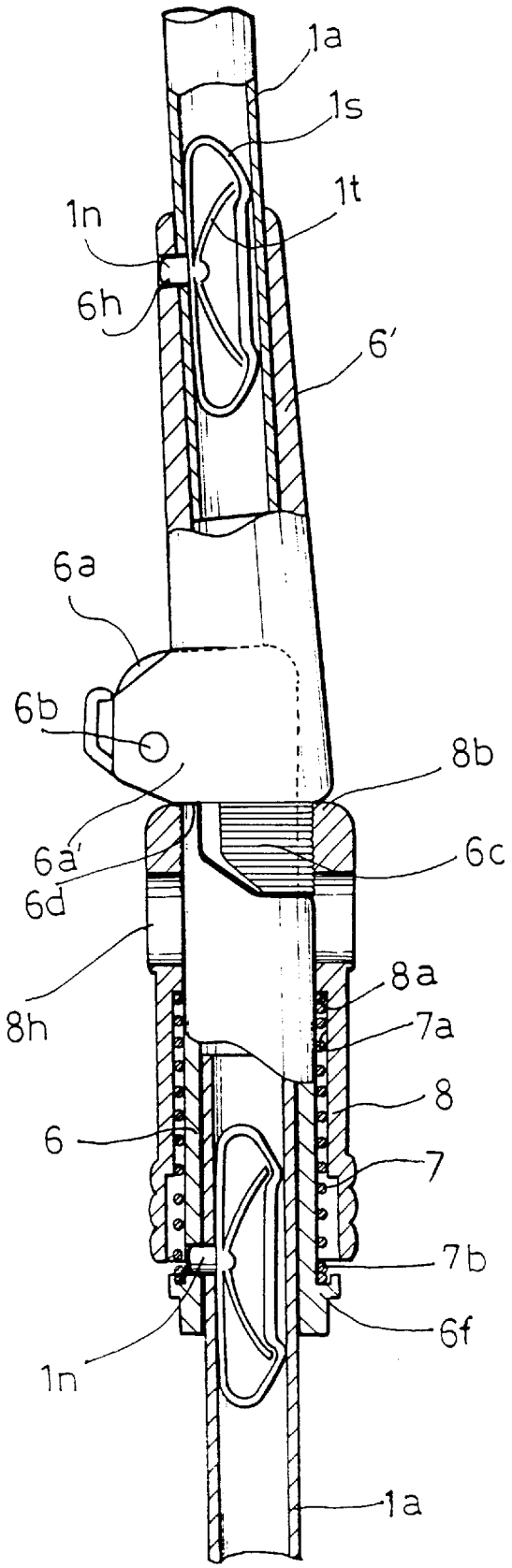
FIG. 5 is a partly sectional view showing the straight joint B of FIG. 2.
Figure 6:
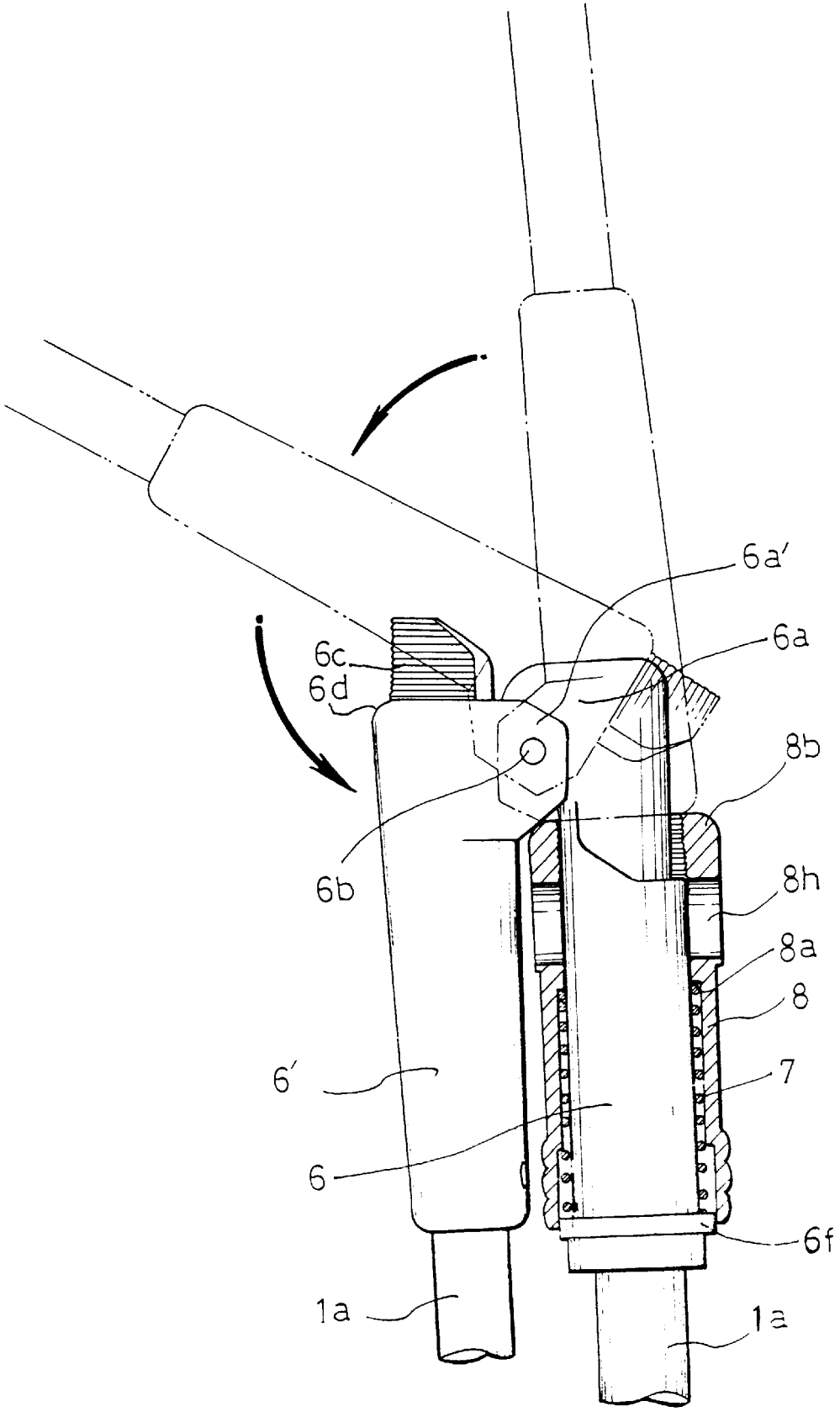
FIG. 6 is a partly sectional view showing the folded state of the straight joint of FIG. 5.

As shown in FIG. 5, the hinged straight joint B is constituted such that a pair of connecting tubes 6 and 6' are connected together through hinge plates 6*a* and 6*a'* and a supporting shaft 6*b* so as to serve as a joint. The rods 1*a* are inserted into the connecting tubes 6 and 6' and fixed through the protuberances 1*n* and holes 6*h*. A coil spring 7 is installed within the connecting tube 6, and a fixing sleeve 8 is fitted to the same connecting tube 6.

A lower end part 7*b* of the spring 7 is supported by an annular step 6f of the connecting tube 6, while an upper end part 7*a* of the spring 7 is supported by an inner step 8*a* so as to exert a pressure against the fixing sleeve 8 owing to the self-elasticity of the spring 7. An upper end part 8*b* of the sleeve 8 which is pressed by the spring 7 pushes a lower end part 6*d* of the connecting tube 6' in a state with an engaging piece 6*c* of the upper connecting tube 6' caught, so that the joint B would be fixed to a straight form upon unfolding the joint B. Thus the frame member can be unfolded to a straight form, or can be folded up. Around the sleeve 8, there are formed several holes 8*h*, so that foreign materials such as sand inadvertently introduced can be removed.

Figure 7:
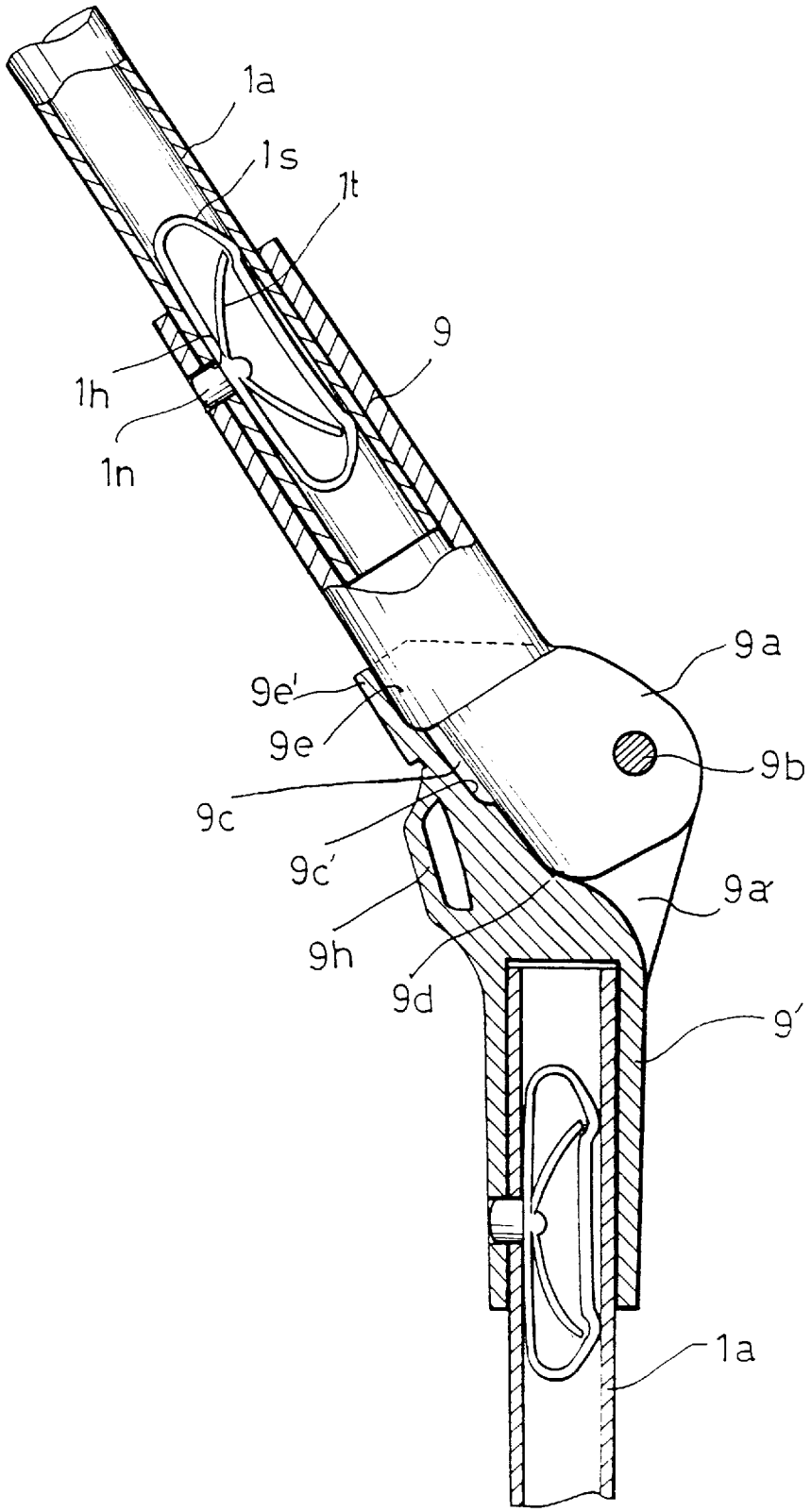
FIG. 7 is a partly sectional view showing the bent joint C of FIG. 2.

As shown in FIG. 7, the bent joint C is constituted such that connecting tubes 9 and 9' with the rods 1*a* coupled there are movably coupled through hinge plates 9*a* and 9*a'* and a supporting shaft 9*b* so as to serve as a joint. On the movably coupled part of the upper connecting tube 9, there is formed a coupling projection 9*c* extending from a lower end part 9*e* of the upper connecting tube 9. On the movably coupling part of the lower connecting tube 9', there are formed an inclined face 9*d* and an inclined end 9*e'* with a certain angle (about 35°–45°). On the inclined face 9*d*, there is formed a recess 9*c'* into which the coupling projection 9*c* is fitted.

Figure 8:
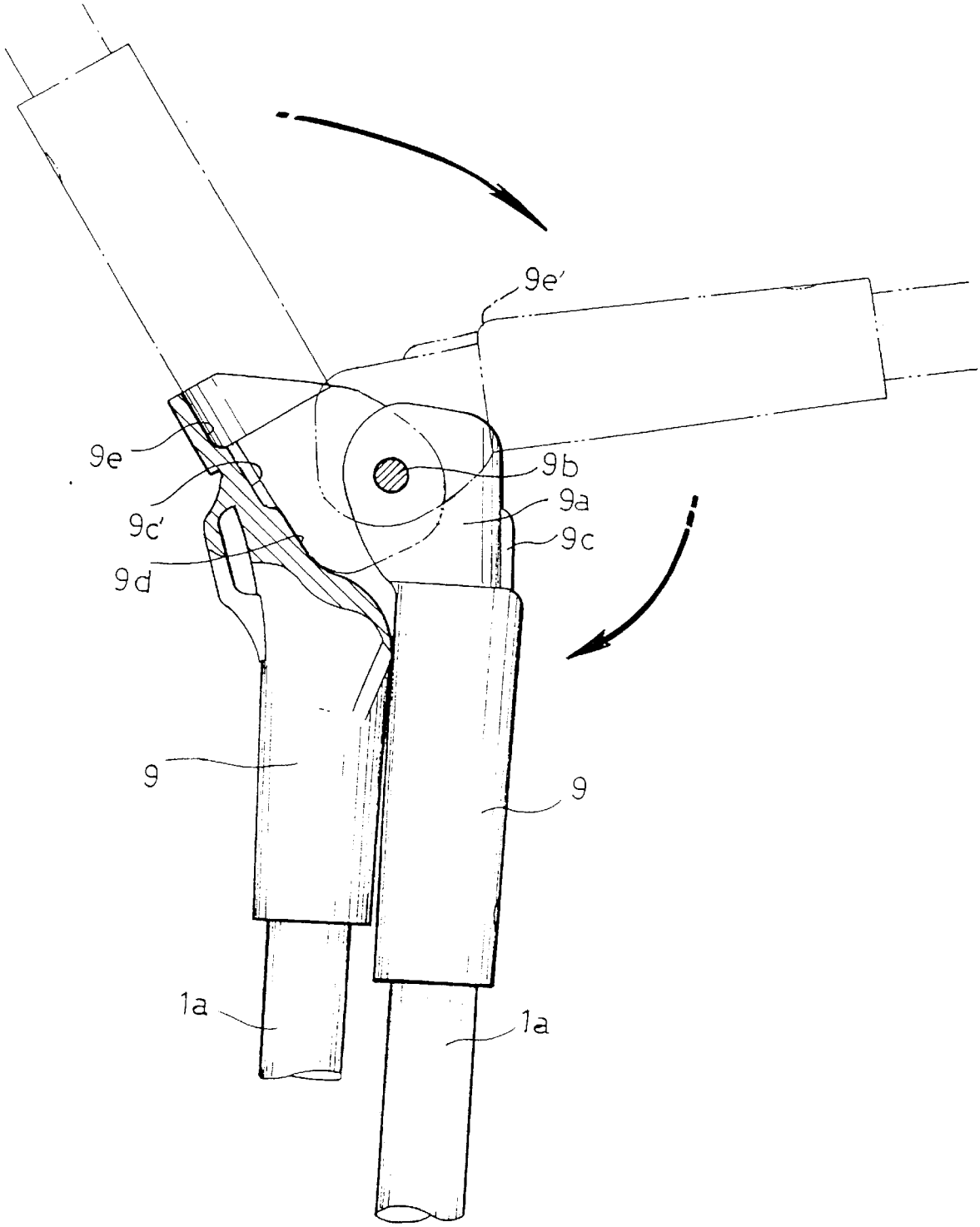
FIG. 8 illustrates the folded state of the bent joint of FIG. 7.

Therefore, as shown in FIG. 8, if the connecting tubes 9 and 9' are pushed outwardly, the tent is folded up. If the connecting tubes 9 and 9' are pushed inwardly, then the joint C is unfolded with a certain angle as shown in FIG. 7. That is, the projection 9*c* is firmly coupled into the recess 9*c*', and the lower end part 9*e* of the connecting tube 9 is firmly coupled with the inclined end part 9*e*', so that the frame member would not be twisted or moved.

In the bent joint C, there is no straight joint or fixing sleeve, and therefore, so much the constitution is simplified. On the lower connecting tube 9', there is formed a guy rope eye 9*h*, so that a rope can be inserted into the rope hole 9*h*, and that the other end of the rope can be secured to the ground, thereby safely protecting the tent from wild winds.

Figure 9:
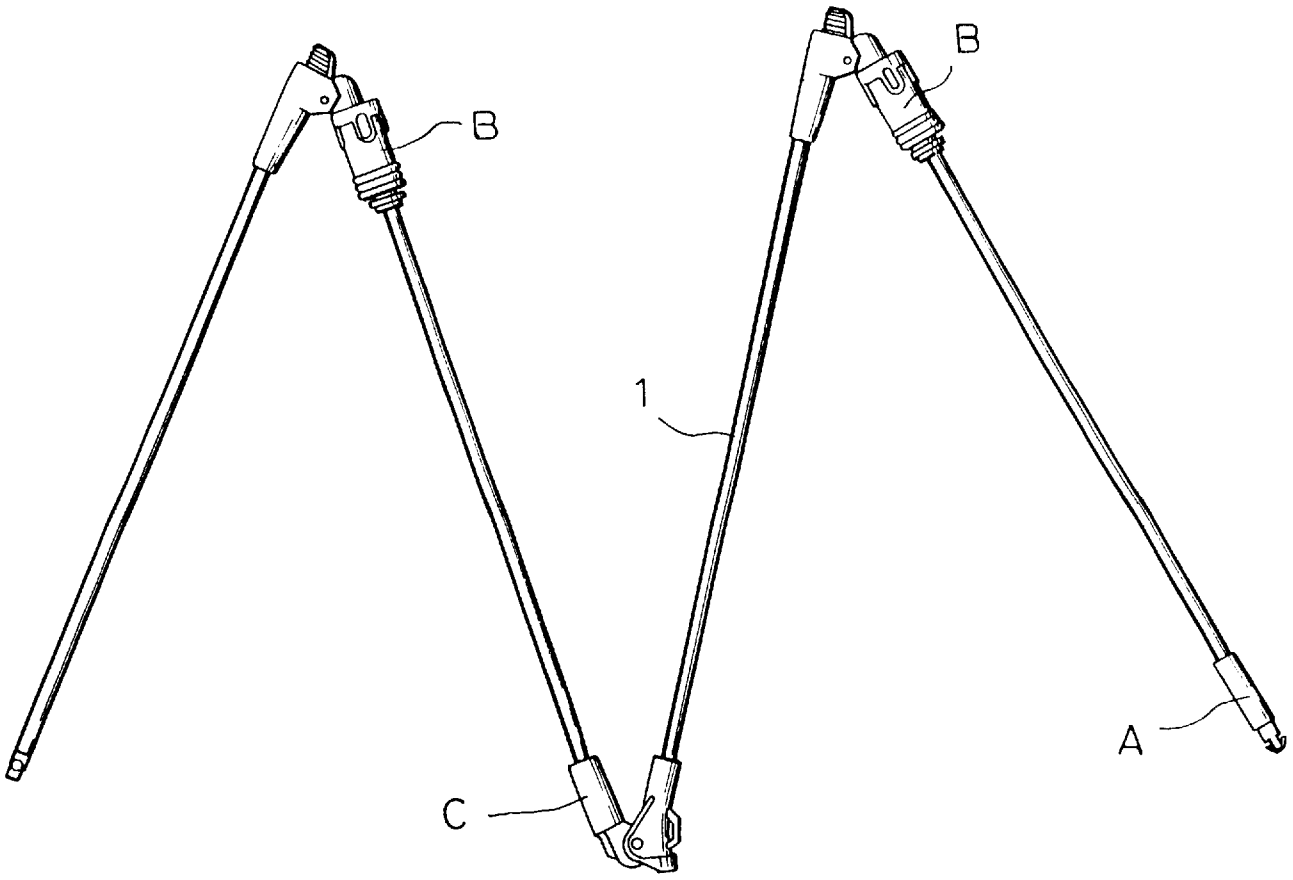
FIG. 9 illustrates a foldable frame member according to the present invention.
Figure 10:
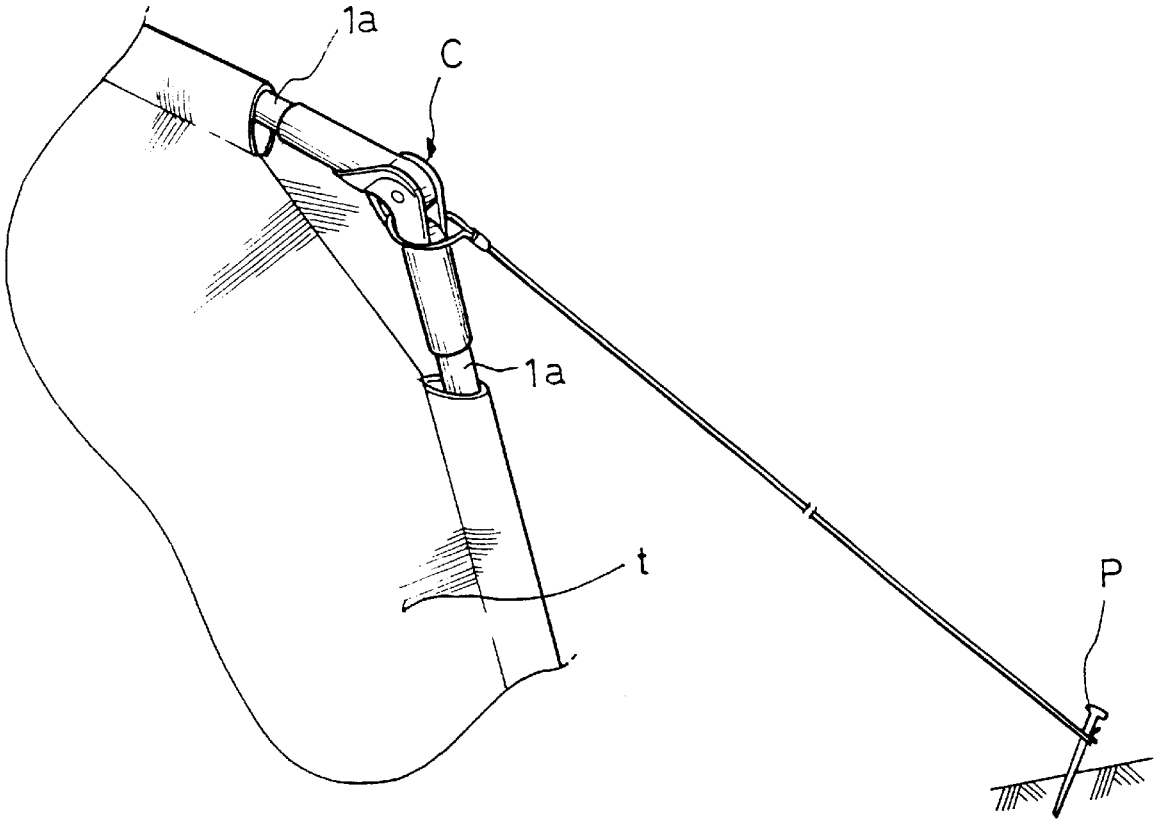
FIG. 10 illustrates a state in which the tent rope is secured to the ground.

As shown in FIG. 9, the tent frame member 1 can be folded up in a zig zag form by utilizing the joints B and C, or it can be straightened. That is, the straight joints B are outwardly folded, while the bent joint C is folded inwardly. Therefore, if the straight joints B is folded by pulling the sleeve 8 against the spring 7 and by bending the connecting tubes 6 and 6' inwardly, and if the bent joint C is folded by bending the connecting tubes 9 and 9' outwardly, then the frame member is folded in a zig zag form into a short length as shown in FIG. 9.

When installing the tent by unfolding the folded frame members, if the sleeve 8 of the straight joint B is pulled, and if the connecting tubes 6 and 6' are forced outwardly, then the straight joint B is unfolded into a straight form. As to the bent joint C, if the connecting tubes 9 and 9' are forced inwardly, then the bent joint C is unfolded into a bent form of a certain angle. At the same time, the projection 9*c* of the connecting tube 9 is firmly coupled with the recess 9*c*' of the connecting tube 9', so that the frame member 1 would serve as a pole and a rafter without being twisted left and right.

Thus if the frame member 1 of the tent t is folded in a zig zag form, the tent is folded into a compact size, and therefore, the carrying, storing and handling are convenient. If the frame members 1 of the tent are unfolded, the tent cloth 2 is supported by the unfolded frame members 1 through the supporting cloths 2*a*. The lower portion of the tent is subjected to a tension through coupling between the supporting plates 5 and the supporting body 4 of the grounding device A, thereby making it possible to set up the tent.

Then if the inserting part 4*b* of the supporting body 4 is inserted into the insertion hole 5*a* of the supporting plate 5, the spread hook 4*a* is engaged with the bottom of the insertion hole 5*a*. Further, the lower portion of each of the frame members 1 serves as a pole to support the tent cloth almost vertically, while the upper portion of each of the frame members 1 serves as a rafter so as to support the tent cloth in an inclined form, thereby forming a tent as shown in FIG. 1. If a securing pin p (stake) is driven through the pin hole 5*b* of the supporting plate 5 into the ground, then the installation of the tent is completed.

According to the present invention as described above, the frame member includes a plurality of rods and two kinds of joints, and therefore, the tent can be folded and unfolded by simple manipulations. Further, the structure is simple, and disorders are not apprehended. Further a spring is not exposed to the outside but is installed within the sleeve. Therefore, the aesthetic appearance of the joints is improved so as to upgrade the commodity value, and a human finger or the tent cloth will not be caught by the spring. Further, the straight joints are constituted such that the connecting tubes are secured by means of a sleeve. The bent joint is constituted such that the connecting tubes are secured through the coupling of the projection with the recess. Therefore, the frame members are not twisted, and therefore, the tent is firmly supported by the frame members even under a strong wind. Particularly, the bottom parts of the frame members are firmly coupled to the supporting plates, and thus, the base of the tent is expanded. Further, if the tent is folded up, the large tent is reduced into a small compact body, and therefore, carrying and storing of the tent becomes convenient. Thus compared with the conventional tents, a convenience of use, a safety of the device and a handling convenience are ensured. Therefore, the present invention can be applied to a large tent in an advantageous manner.

What is claimed is:

1. A foldable tent frame for a large tent, the tent having a tent cloth 2 provided with sleeve-like supporting cloths 2*a*, said foldable tent frame comprising:

a) a central hub 3;

b) a plurality of frame members 1 each having an upper tip movably joined to said hub 3, said frame members 1 for coupling with the tent cloth 2 through the supporting cloths 2*a* in an integral form, each of said frame members 1 comprising:

i) a plurality rods 1*a*;

ii) two hinged straight joints B connecting said rods 1*a*;

iii) a hinged bent joint C connecting said rods 1*a* and disposed between said two straight joints B across said rods 1*a*;

iv) a grounding device A connected through one of said rods to said hinged bent joint C and forming a lowermost portion of said frame member 1, whereby a lower portion of said frame member below said hinged bent joint C serves as a supporting pole, and an upper portion of said frame member above said hinged bent joint C serves as a rafter; and wherein c) said hinged bent joint C comprises:

i) upper and lower connecting tubes 9 and 9' pivotally joined together through respective upper and lower hinge plates 9*a* and 9*a*' and through a transverse supporting shaft 9*b*;

ii) said lower hinge plate 9*a*' having an inclined seating surface 9*d* for holding said upper hinge plate 9*a* at a desired inwardly inclined angle in a direction facing said central hub 3, said angle falling in a range of about 3.5 degrees to about 45 degrees;

iii) said inclined seating surface 9*d* of said lower hinge plate 9*a*' having a recess 9*c*' formed therein;

iv) said upper hinge plate 9*a* including a coupling projection 9*c* that is receiving by engaged by said recess 9*c*' as said upper hinge plate 9*a* is rotated counter clockwise into engagement with said inclined seating surface 9*d*; and v) said hinged bent joint C being inwardly foldable towards said central hub 3 such that an inward force applied at said hinged bent joint C rotates said upper hinge plate 9*a* and connecting tube 9 in a clockwise direction from a first, deployed position wherein said upper hinge plate 9*a* and connecting tube 9 are held at said desired inclined angle into a second, compactly folded position wherein said upper hinge plate 9*a* and connecting tube 9 are disposed adjacent said lower hinge plate 9*a*' and connecting tube 9', respectively.

2. The foldable tent frame as claimed in claim 1, wherein said grounding device A comprises:

a tubular supporting body 4 coupled to a lowermost rod 1*a*; and an insertion part 4 having a V shaped hook 4*a* formed on a lower tip of said supporting body 4, whereby said insertion part 4*b* of said supporting body 4 is inserted into a supporting plate 5 so as to couple a bottom edge of the tent cloth 2 to a bottom part of said frame member 1.

3. The foldable tent frame as claimed in claim 1, wherein each of said hinged straight joints B comprises:

lower and upper connecting tubes 6 and 6' movably joined together through hinge plates 6*a* and 6*a*' and through a supporting shaft 6*a*;

an engaging piece 6*d* formed on a lower end of said upper connecting tube 6';

a spring 7 installed between said lower connecting tube 6 and a securing sleeve 8; and said securing sleeve 8 fitted around said lower connecting tube 6, whereby said straight joint B is fixed in an unfolded state after being unfolded by means of said spring 7 and said sleeve 8.

4. The foldable tent frame as claimed in claim 3, wherein:

said securing sleeve 8 of said hinged straight joint B includes an upper end portion 8*b*;

said spring 7 providing bias to said securing sleeve so that said upper end portion 8*b* receivingly engages engaging piece 6*c* of said upper connecting tube 6' as said hinged straight joint is unfolded into a straight form.

5. The foldable tent frame as claimed in claim 3, wherein an upper portion 7*a* of said spring 7 is pressed by an inner annular step of said sleeve 8, and a lower end portion 7*b* of said spring 7 engaged with an annular step 6*f* of said lower connecting tube 6.

6. The foldable tent frame as claimed in claim 2, wherein said supporting plate 5 comprises an insertion hole 5*a*, a pin hole 5*b* and connecting holes 5*c*, whereby said supporting plate 5 is connected through a band 2*b* to said tent cloth 2, said supporting body 4 is inserted into said insertion hole 5*a*.

7. The foldable tent frame as claimed in claim 1, wherein said rod 1*a* comprises:

a coupling protuberance 1*n*;

a flat spring 1*s* having an elliptical form with symmetric bendings; and an auxiliary spring 1*t*, whereby said coupling protuberance 1*n* is formed on the center of said springs 1*s* and 1*t*.

8. The foldable tent frame as claimed in claim 3, wherein said securing sleeve 8 comprises holes 8*h* for discharging foreign materials such as sands.

* * * * *